US006240700B1

(12) United States Patent
Sheu

(10) Patent No.: US 6,240,700 B1
(45) Date of Patent: Jun. 5, 2001

(54) CONSTRUCTING METHOD FOR UNDERGROUND CONTINUOUS DOUBLE-ROW WALLS AND THE STRUCTURE OF CONTINUOUS DOUBLE-ROW WALLS

(76) Inventor: Chyi Sheu, P.O. Box 90, Tainan City (TW)

( * ) Notice: Subject to any disclaimer, the term of this patent is extended or adjusted under 35 U.S.C. 154(b) by 0 days.

(21) Appl. No.: 09/416,535

(22) Filed: Oct. 12, 1999

(51) Int. Cl.[7] ..... E02D 5/20

(52) U.S. Cl. ..... 52/741.13; 52/169.1; 52/745.2; 52/309.12; 52/309.11; 52/741.11; 52/745.19; 405/267

(58) Field of Search ..... 405/267, 249; 52/169.1, 742.1, 745.2, 741.13, 309.12, 309.11, 741.11, 745.19, 577, 602, 669

(56) References Cited

U.S. PATENT DOCUMENTS 4,005,582 * 2/1977 Tamaro ..... 405/267
4,073,148 * 2/1978 Zaretti ..... 405/287
4,075,852 * 2/1978 Tamaro ..... 405/267
4,259,028 * 3/1981 Cook ..... 405/282
4,453,861 * 6/1984 Bretz et al. ..... 405/267
5,259,705 * 11/1993 Breaux et al. ..... 405/267

* cited by examiner

*Primary Examiner*—Christopher T. Kent
*Assistant Examiner*—Jennifer I. Thissell

(57) ABSTRACT

A constructing method for underground continuous double-row walls and a structure of continuous double-row walls includes a plurality of steps. The steps are used to prepare guide walls, to dig ditches, to check verticality, to remove dirt and mud on the bottom of the ditches and to wash end plates, to prefabricate wall units of continuous double-row walls, and to place wall units in the ditches until the continuous wall is finished. The structure of a wall unit includes two base plates, two frameworks having plural auxiliary frames vertically between the two base plates, plural lateral bars fixed laterally with each auxiliary frame, plural net members fixed between two auxiliary frames, plural steel bars fixed between every two auxiliary frames, outer mold plates fixed on the outer sides of the framework, and concrete poured in the space between the mold plates and the net members.

16 Claims, 10 Drawing Sheets

CONSTRUCTING METHOD FOR UNDERGROUND CONTINUOUS DOUBLE-ROW WALLS AND THE STRUCTURE OF CONTINUOUS DOUBLE-ROW WALLS

BACKGROUND OF INVENTION

This invention relates to a constructing method for underground continuous walls of double rows and the structure of double-row continuous walls, particularly to one of a compound constructing method for mass production of continuous double-row wall s having an outer wall and an inner wall, with the intermediate portion between the outer and the inner wall being filled with concrete at work site. A first step of the constructing method is to build a guide wall in the preset range of a location. A second step is to dig a ditch down in the ground based on the guide walls. A third step is to check the verticality of the ditch when the ditch is dug to a preset depth. A fourth step is to wash stop plates, and remove dirt and mud on the bottom of the ditch. A fifth step is to construct a single double-row wall unit for continuous double-row walls at a process site. A sixth step is to place a plurality of the single double-row wall units orderly in the ditch, and pour in concrete from the uppermost wall unit, finishing a round of construction of the underground continuous walls. In this method, each wall unit in the continuous walls is connected to each other stably, effectively preventing water from seeping in, also preventing soil slip and soil mixing in concrete from happening. In addition, it can improve protective layers of reinforcement, insufficient bend stress, rupture of wall bodies, corrosion of steel bars (reinforcement), and improper mixing of sand with concrete. At the same time, an upper and a lower wall unit are screwed together with bolts and nuts to form a unit of continuous walls, with the depth of construction not limited and with management of construction being easy to control.

A conventional method of constructing underground continuous walls generally digs deep ditches around the range of the building location, placing steel bar cages in the ditches (or placing pre-formed PC (precast concrete) plate). Then concrete (or a hardener is poured into two sides of the PC plates to form a wall) is poured into the ditches to form a wall unit of a continuous wall.

However, the conventional method has the following disadvantages.

1. Every two neighboring wall units of a continuous walls are not connected with a secure connecting means, with a gap possibly formed between them, thereby rendering it impossible to tightly connect the units to each other, and thus not satisfying necessary water-tightness and strength requirements.

2. The gap formed between every two neighboring wall units may function as an inlet for water to flow therethrough. Then continuous walls may have water leak, leading to danger to construction and trouble of water leak after completion of the construction.

3. A pouring hole is preset in steel bar cages for pouring concrete to form a single wall unit after concrete hardens. But as ditches are generally narrow and very deep (normally 10 meters or so), and concrete is poured in the ditches full of stabilizing liquid (grouting), causing the steel bar cages to be soiled by the stabilizing liquid to affect its bend stress, also causing soil and mud liable to mix in the concrete to reduce strength of the concrete, and thus lowering strength and quality of the walls.

4. PC (precast concrete) plates are not connected to each other with connecting means, only kept together by hardener filled in the two sides of the PC plate. And mixing propoetion of the hardener and time error can cause property change to the hardener, largely affecting the strength of the whole wall.

5. Its constructing work is effected by pouring concrete into steel bar cages put in dug ditches. But there may be problems in managing construction, verticality of ditches, smoothness of concrete surfaces, insufficient thickness of reinforcement layers. Above all, chances are that rupture of wall bodies, corrosion of steel bars, harming the ground wall, and increasing constructing work may occur.

6. Constructing is done in ditches full of stabilizing liquid, and steel bar cages (or PC plates) are of a large dimensions, causing difficulty in performing construction and in controlling quality. So it is often necessary to construct other walls inside the continuous walls to hide rough or cracked surfaces, reducing the dimensions of a basement, needing frequent reinforcing work, wasting labor and time and materials.

SUMMARY OF THE INVENTION

One objective of the invention is to offer a constructing method for underground continuous double-row walls, wherein every two neighboring wall units are connected to each other tightly, having effective water-proof feature, obtaining reinforcing layer and good bend stress, preventing soil slip and soil mixing in concrete and improper sand mixing in concrete to lower quality.

Another objective of the invention is to offer a constructing method for underground continuous double-row walls, convenient to manage construction, easy to control, and saving work of surface smoothing.

One more objective of the invention is to offer a constructing method for underground continuous double-row walls and the structure of continuous double-row walls, convenient to transport and not limited in the depth of the walls.

The feature of the invention is the constructing steps including (1) constructing of guide walls, (2) digging ditches, (3) checking verticality, (4) washing stop plates, and removing dirt and mud on the bottom of the ditches, (5) constructing a first single wall unit of continuous double-row walls having two rows, an upper and a lower base plate located symmetrically, a frame-work fixed between the upper and the lower base plate, plural auxiliary frames fixed between the upper and the lower base plate, plural lateral bars fixed with each auxiliary frame, plural net members fixed on each auxiliary frame, a truss-type steel bar provided between two auxiliary frames; mold plates fixed on an outer side of the prefabricated framework of the single wall unit, and then concrete is poured into the single wall unit, (6) connecting upper and lower wall units, and placing the connected wall units in the ditches, and pouring concrete down from the uppermost wall unit, (7) repeating the second step to the sixth step described above until continuous walls are finished.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
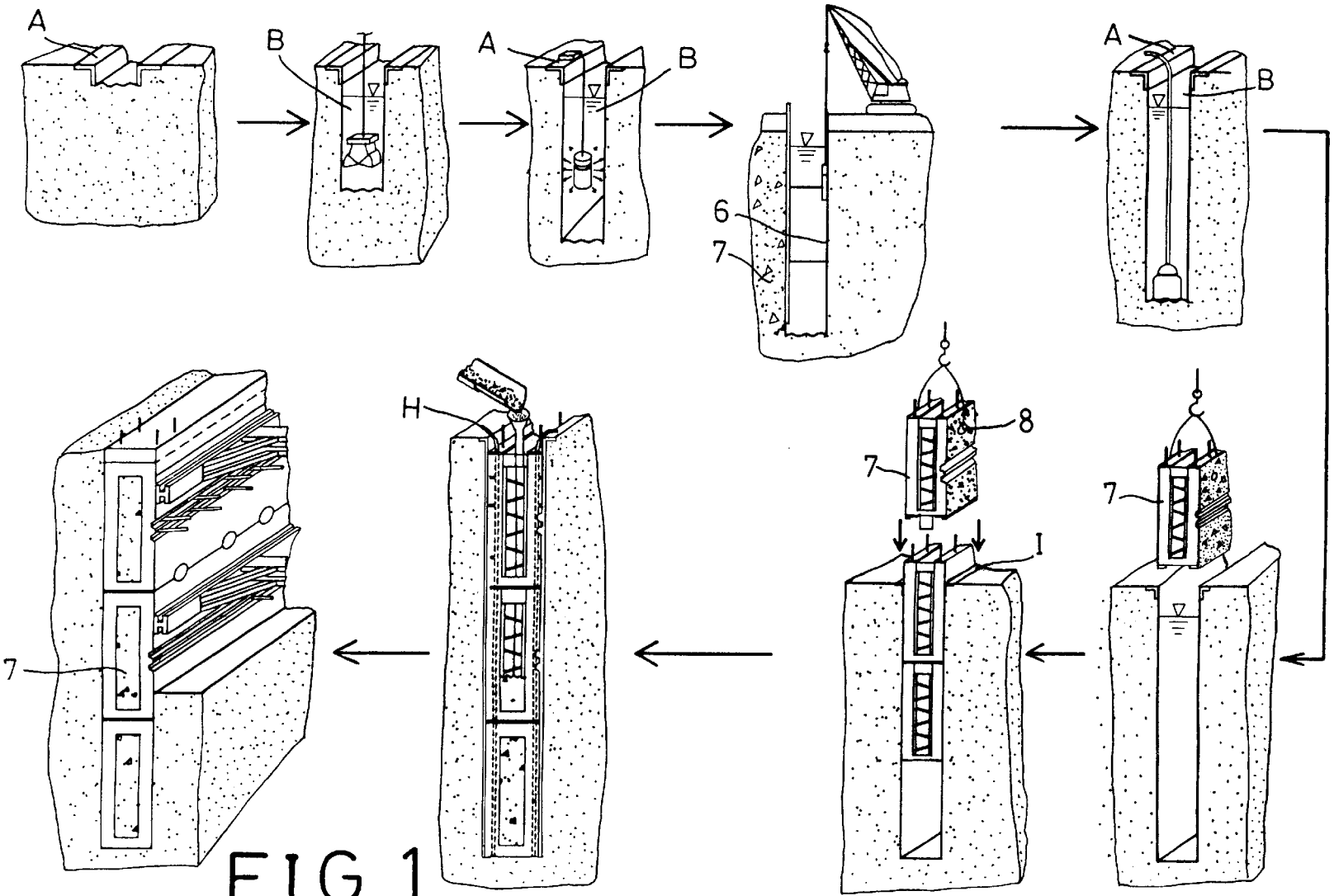
FIG. 1 is a flow chart of a constructing method for underground continuous double-row walls according to the invention.

A preferred embodiment of a constructing method for underground continuous double-row walls in the present invention, as shown in FIG. 1, includes a plurality of steps described below.

1. A first step is to construct guide walls A. First a shallow ditch is dug at the location where underground continuous walls are to be constructed, and the guide walls A are constructed on the ditch.

2. A second step is to dig a ditch B. A deep ditch B is dug vertically from the guide ditches A with a ditcher, removing stone and soil dug up from the ditch B, making a deep ditch for placing continuous walls therein. In order to prevent the ditch from collapsing, stabilizing liquid (i.e. grouting) is poured in the ditch B during digging process, keeping stable the ground of the vertical surfaces of the ditch B.

3. A third step of checking the verticality of the ditch. When the ditch B is dug to a preset depth, verticality of the ditch has to be checked first with a measuring instrument (maybe a supersonic one), and the surfaces of the ditch have to be checked whether they have smoothness or not, whether their surfaces may collapse or not, whether they have recesses or not, for effectively ensuring exactness of the wall bodies 7 and advantages for constructing continuous walls.

4. A forth stop of removing dirt and mud and washing end (stop) plates. Dirt and mud remained on the bottom of the ditches B is to be removed, and the end plates (stop) plates, or plates 60 of a connect mechamism 6 of the wall units 7) are to be washed cleanly.

5. A fifth step of depositing a first double-layer wall unit 7 of the continuous walls. A first wall unit 7 is hung and carried onto the upper mouth of the ditch B, prefabricated to have double rows of walls at a process site, with its outer surfaces treated with water-proof material (such as water-proof glue).

The wall unit 7 consists of:

Two units of upper and lower base plates 1 made of Tee steel, or channel steel, located symmetrical, having a connect plate 10 horizontally positioned, a reinforcing plate 11 vertical positioned. The connect plate 10 has some through holes 100 of different size. Further, plural shear force steel members 111 may be provided on the surface of vertical plate of the upper and the lower base plates 1, depending on clamping force of cement.

Figure 5:
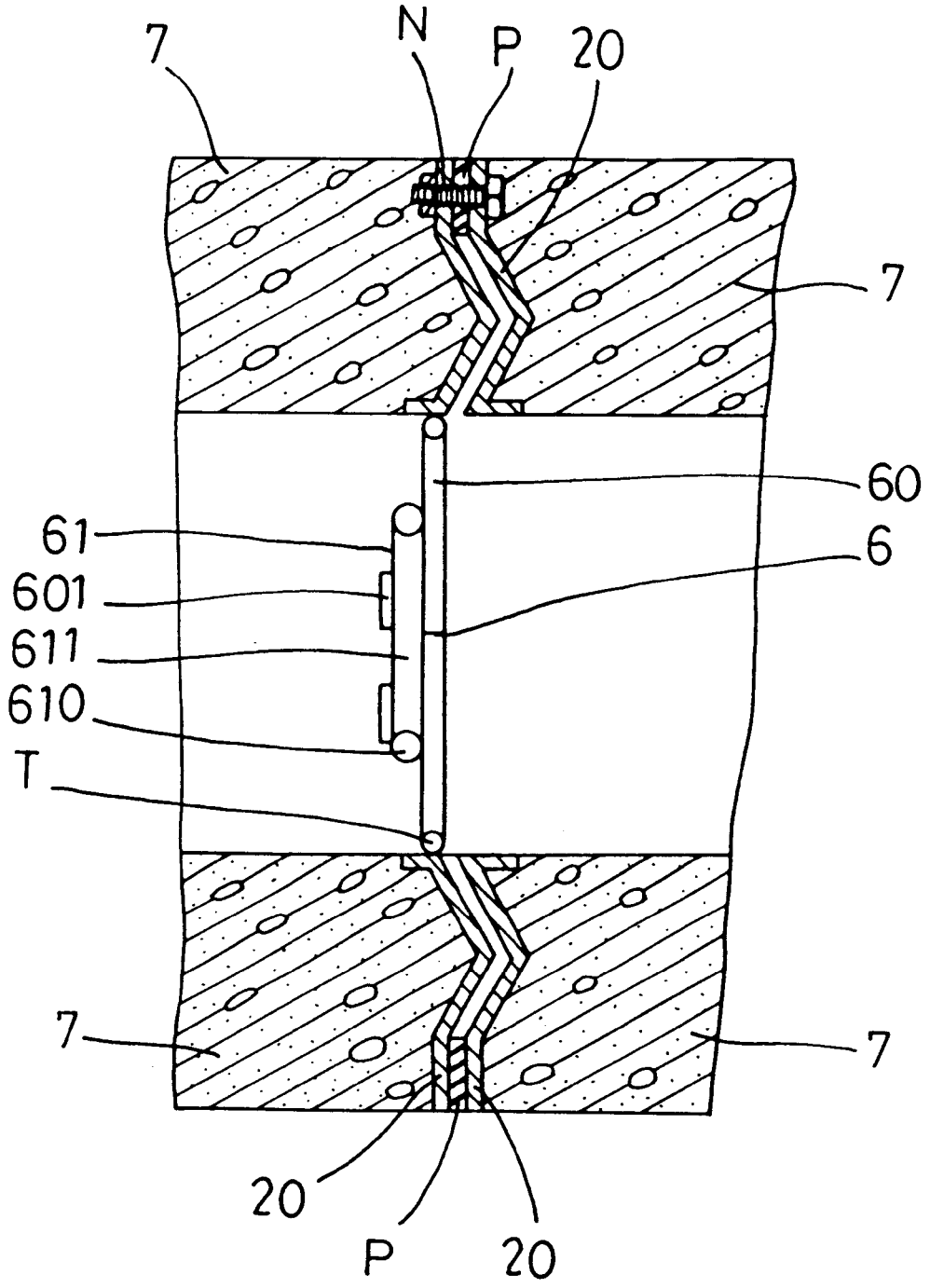
FIG. 5 is a cross-sectional view of a connect mechanism and a side frame connected with each other in the present invention.
Figure 6:
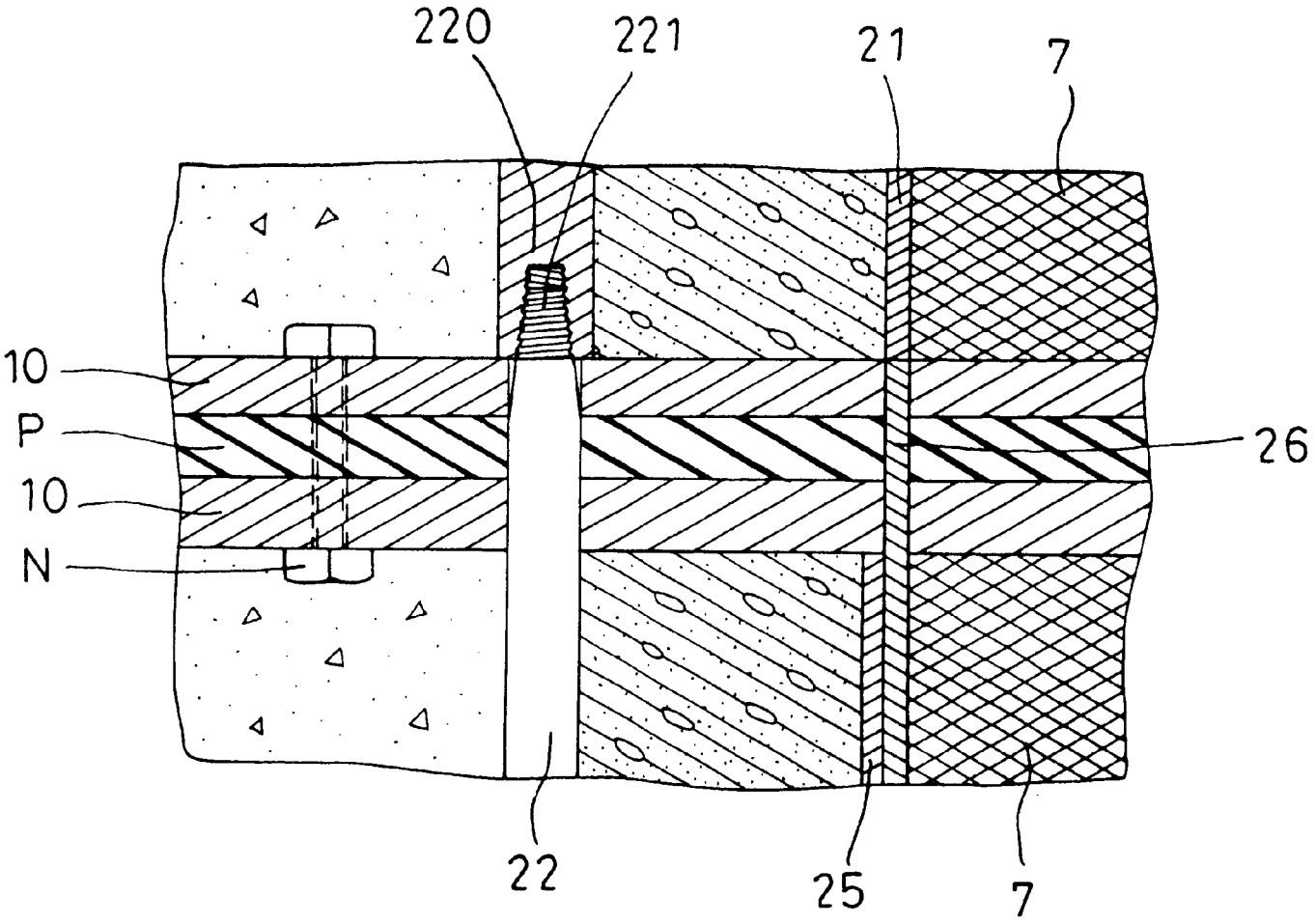
FIG. 6 is a partial cross-sectional view of connection of an upper and a lower wall unit in the present invention.

A framework 2 is combined between the two base plates 1, resting against an inner wall of the reinforcing plates 11, having a side frame 20 made of a Tee steel or a bent flat plate, or two bent parallel plates as shown in FIG. 5. Further, plural threaded holes 200 are provided through the plate walls. A plurality of auxiliary frames 21 are provided spaced apart between the two frameworks 2, made of angle or channel steel or steel bars. Support rods 22 may be provided between two auxiliary frames 21 if necessary, and having its bottom end formed as a connect end 220 to fit in a hole of the structural body. At the same time, as shown in FIG. 6, if the support rod 22 is made of a steel bar, a connector can be used to connect with the connect end 220, enabling connection of the upper and the lower wall unit 7 fast and stable. And an extension 221 of the other end of the support rod 22 extends through the surface of the connect plate 10, convenient for the upper and the lower wall unit to connect with each other.

Figure 2:
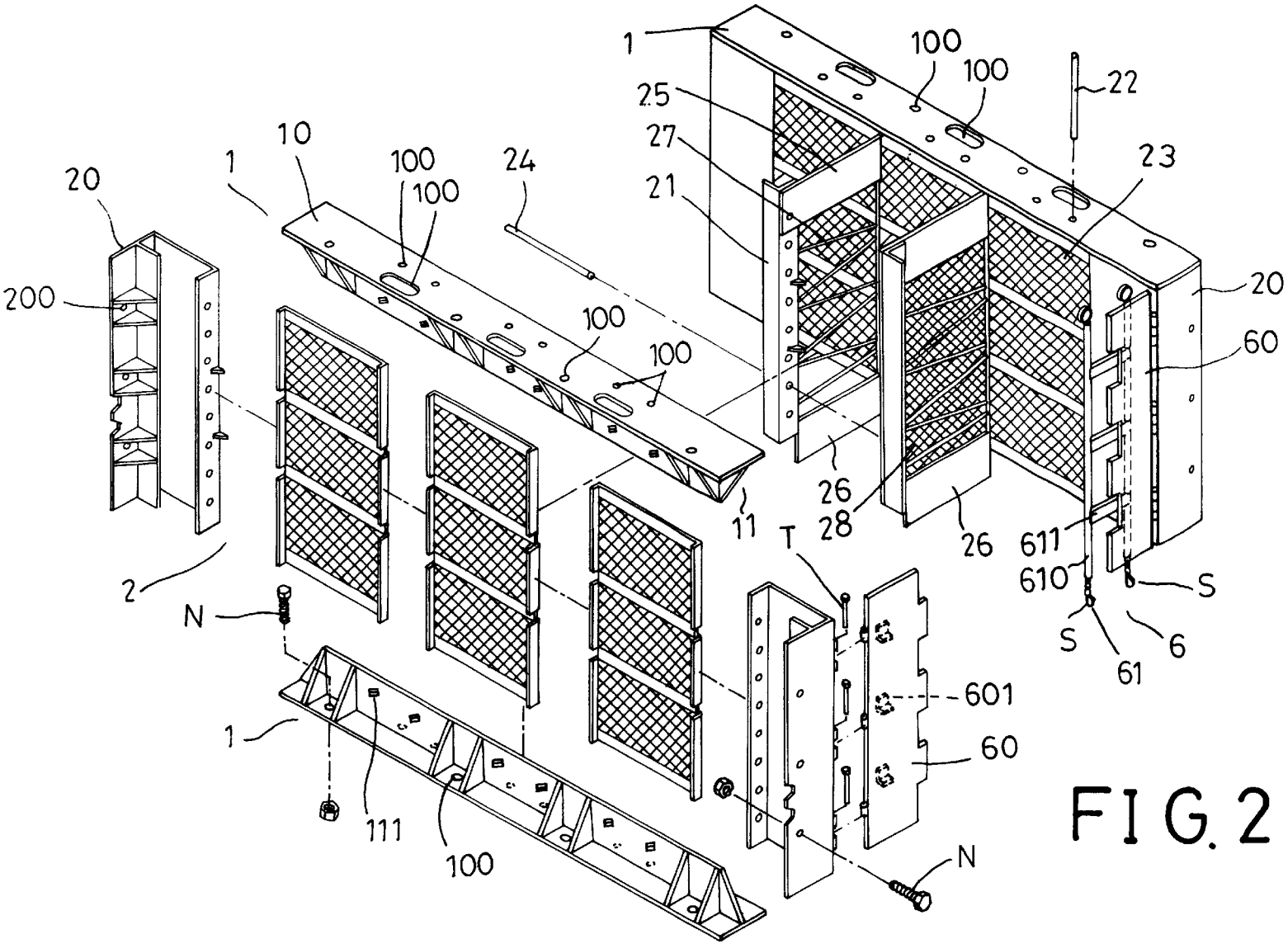
FIG. 2 is an exploded perspective view of a single double-row wall unit in the present invention.
Figure 7:
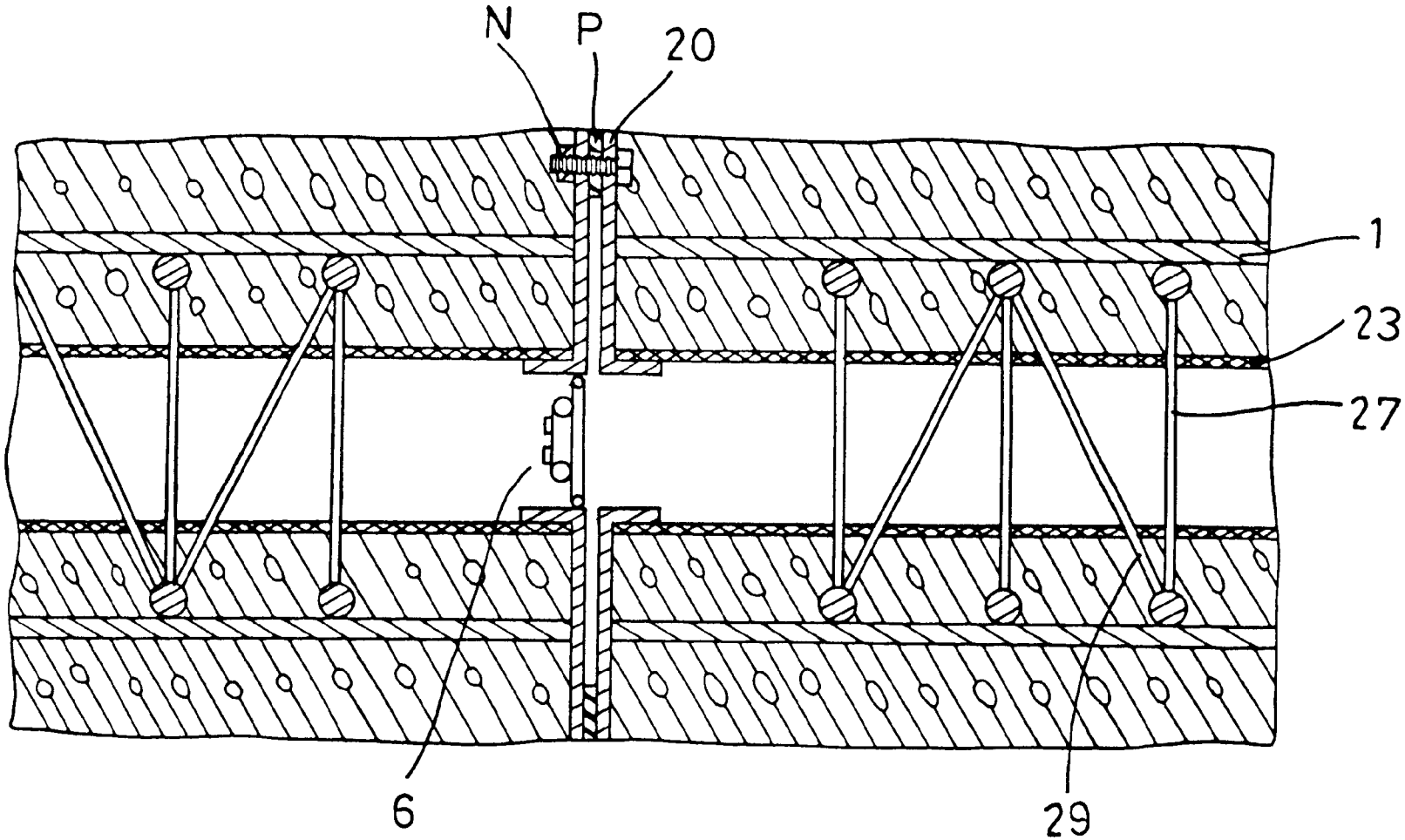
FIG. 7 is a cross-sectional view of reinforcing steel bars between the double-row walls of a single wall unit in the present invention.

Further, plural net members 23 are fixed between two auxiliary frames 21, and a lateral rod 24 is provided between the two side frames 20, fixed tightly with the auxiliary frames 21. A connect plate 25 is respectively fixed laterally on an upper side of each auxiliary frame 21, and an insert plate 26 is each fixed laterally on a lower side of each auxiliary frame 21, as shown in FIGS. 2 and 6. Then the insert plate 26 of an upper wall unit 7 may rest against the connect plate 25 of a lower wall unit 7, and a ladder-shaped steel bar 27 may be fixed inside two auxiliary frames 21 and the side frame 20. A separating plate 28 of a net or porous or plate shape is fixed on a proper location of the side frame 20 (near a side of the connect mechanism 6), and between the two frameworks 2, and also on the steel bar 27 on the auxiliary frame 21. A truss-type reinforcing steel bar 29 may be fixed between the net members 23 of the framework 2, depending on the strength of the single wall unit 7, as shown in FIG. 7.

Plural connect steel bars 3 are provided to extend from the framework 2 or the lateral bar 24 toward a wall of a basement to connect to steel bars of the structure of the basement. The connect steel bars 3 is bent in a preset hole or formed as various steel connectors, as shown in FIGS. 1 and 4.

Figure 3:
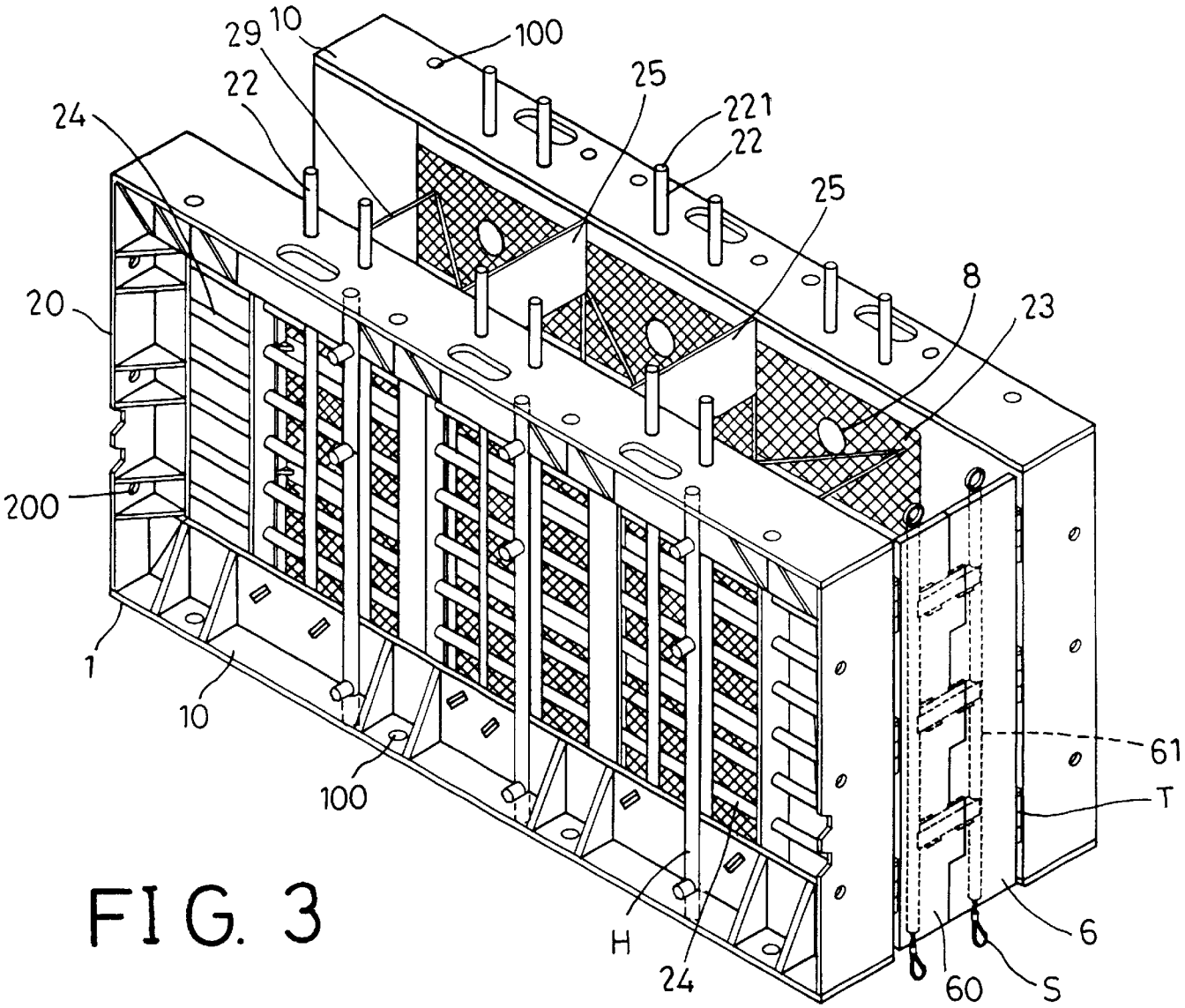
FIG. 3 is a perspective view of the single double-row wall unit in the present invention.
Figure 4:
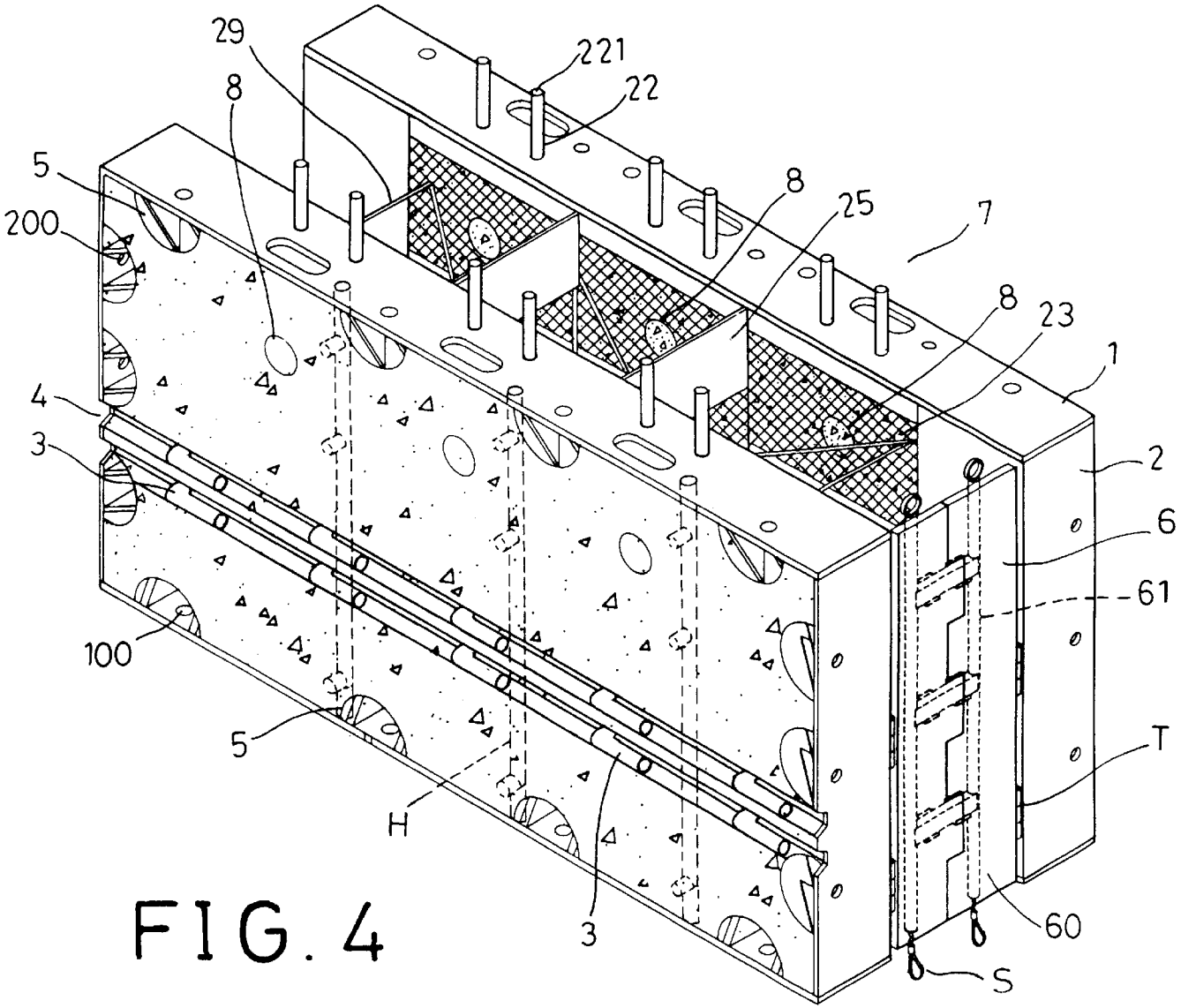
FIG. 4 is another perspective view of the single double-row wall unit in the present invention.

In order to connect the continuous walls with the structure of the basement, in combining mold plates, grooves 4, as shown in FIG. 4, are preset. Besides, the the upper and the lower wall units 7 are provided with plural recesses 5 along the connect plate 10 to align with each other when the upper and the lower wall unit 7 are piled on each other so as to let bolts and nuts N to pass through the holes 100 inside the recesses 5 to secure the upper and the lower wall units 7. Further, the side frames 20 of a front and a rear wall units 7 also have recesses 5 to align to each other when the front and the rear wall units are connected together, for bolts and nuts N to screw the threaded holes 200 to secure the front and the rear wall units 7 stably. In addition, the connect mechanism 6 has plural hang holes 8 in an upper portion, and the holes 8 extends through the double rows of walls, as shown in FIG. 3 and 4.

Next, outer mold plates are fixed on an outer side of the frame mechanism 2 of the double-layer wall unit, a concrete room is formed between the outer mold plates and the net members 23, and concrete is poured through the large holes 100 of the upper base plate 1 into the wall space. After concrete hardens, the outer mold plates are removed, and the concrete forms a double-row wall unit 7.

As there is a gap remained between the ditch B and the walls of the single wall unit 7, plural vertical pour pipes H are preset beside each hole 100 of the upper base plate 1 so as to pour grouting into the pour pipes H to flow out of the outside surface to fill up the gap, securing the wall body 7 stabilized in the ditch B.

Next, the connect mechanism 6 is pivotally provided between the two double-row wall units 7, as shown in FIGS. 2, 3, 5, 8, and 9. mainly including two pairs of opposite two plates 60 pivotally connected with each other with hinges, permitting one of the two plates 60 swing open freely as a door. Further the swingable plate 60 has hooks 601 fixed on an inner surface, for a stop means 61 to be hooked in the hooks 601 and stopping the inner side of the swingable plate 60. Further, a vertical rod 610 and lateral latch rods 611 extending horizontal from the vertical rod 610, forming something like a ladder, with the lateral latch rods 611 hooked in the hooks 601, securing the swingable plate 60 immovable temporarily. Thus, the connect mechanism 6 functions as two stop ends of the single wall unit 7.

Figure 8:
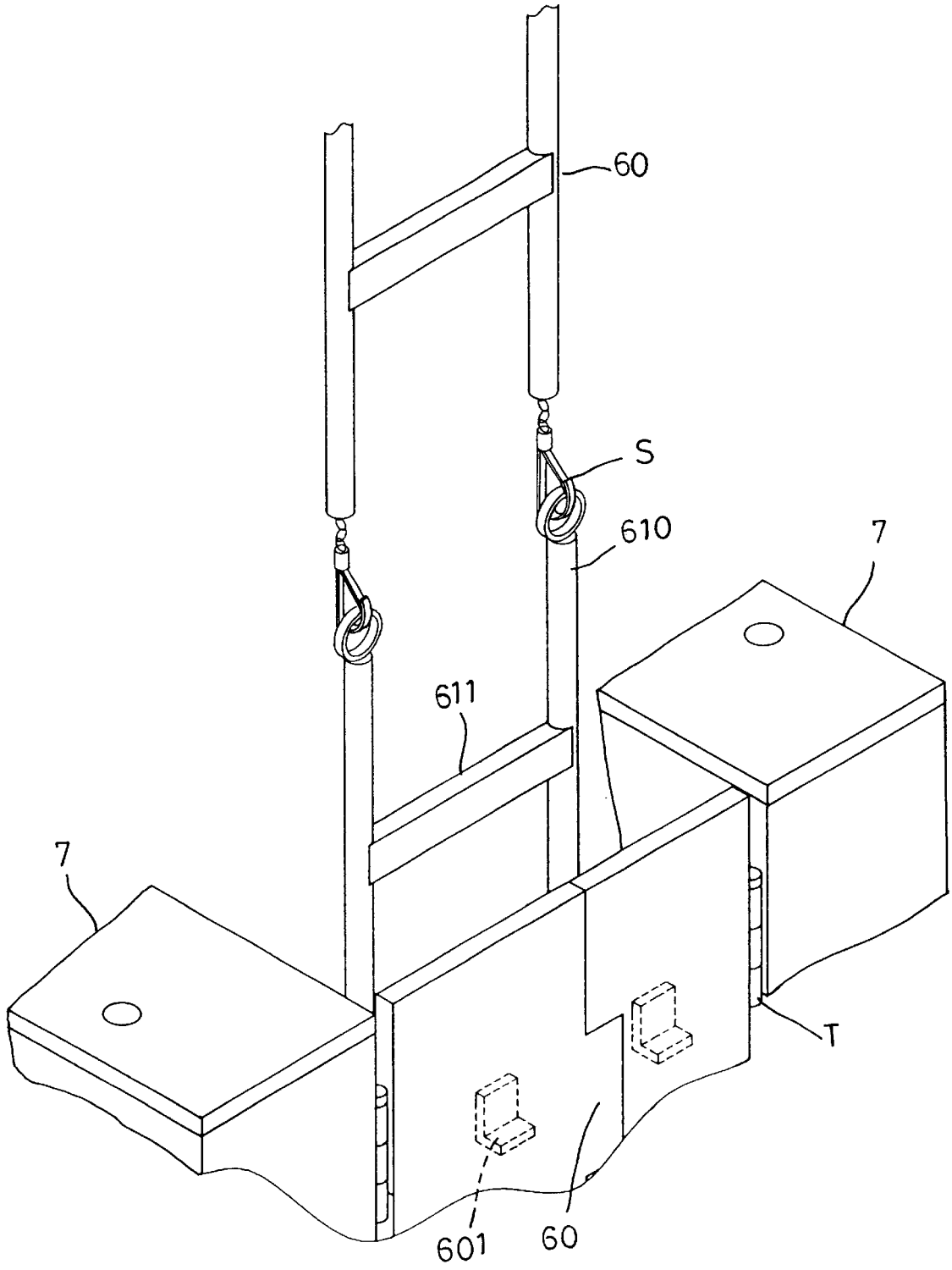
FIG. 8 is a perspective view of a stop means of the connect mechanism in the present invention.

6. A sixth step of connecting an upper and a lower single wall unit 7. A first wall unit 7 is slowly hung up, carried and placed in the ditch B, with channel steels as load rods I passing through the hang holes 8, and a second wall unit 7 is placed on the first wall unit 7, and clamp type hook latches S of the stop means 61 are used to connect the two wall units 7 as shown in FIG. 8. Then the extend end 221 of the support rods 22 of the lower wall unit 7 is inserted in the connect end 220 of the support rods 22 of the upper wall unit 7, as shown in FIG. 6. The insert plate 26 of the upper wall unit 7 is made to contact the connect plate 25 of the lower wall unit. Further, a water-proof band P is laid between the upper and the lower base plate 1, as shown in FIG. 6. Then the recesses 5 and the holes 100 of the upper and the lower wall unit 7 are aligned to each other, and bolts and nuts N are used to screw through the holes 100 so as to secure the upper and the lower wall unit 7 together. Then the two wall units 7 combined together are hung up and the load rods I are removed, and the two wall units 7 are lowered in the ditch B. In this way, plural wall units 7 are placed in the ditch B to a preset depth, i.e. the uppermost wall unit 7 has its upper surface flush with the upper mouth of the ditch B. The concrete is poured through the uppermost wall unit 7 down, with the separating plates 28 functioning to stop concrete (then occupying two thirds of the dimensions of a single wall unit). And grouting is also poured in the pour pipes H to fill up the gap between the wall unit 7 and the ditch B, finishing the first round of construction of the continuous walls.

7. A seventh step of repeating the second step to the sixth step for another round (a second one) of wall construction. In hanging and placing wall units 7 in the second round, rollers may be used on the upper surface of the wall units to guide to move the wall units 7 of the second round so as to position the wall units 7 of the first and the second round tightly contact each other. And the water-proof bands P are also laid between the wall units 7 of the first and the second round to effectively upgrade water preventing function of the connect points, as shown FIGS. 5, 6 and 7.

Figure 9:
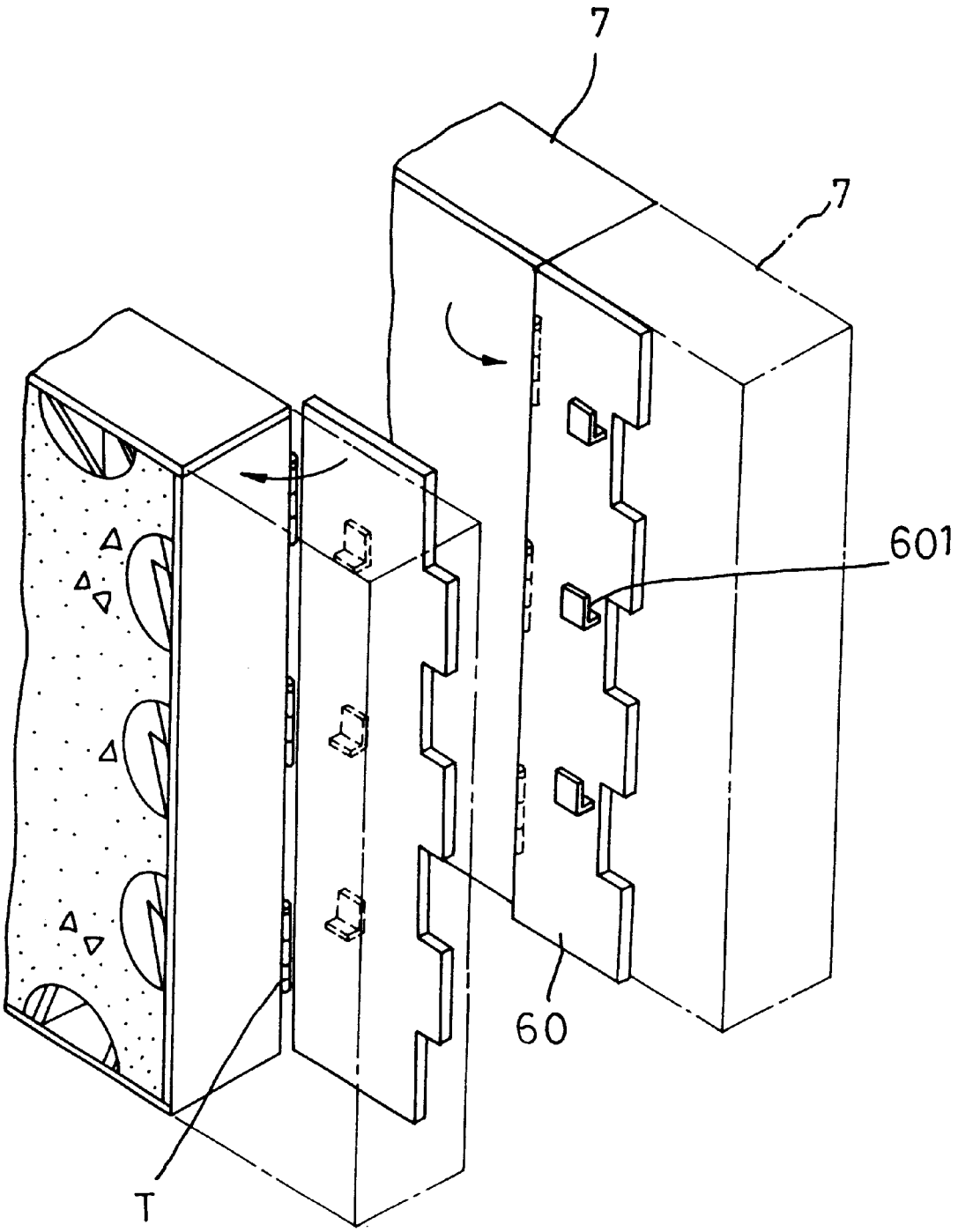
FIG. 9 is a perspective view of plate members of the connect mechanism in pushed-open condition in the present invention.

After the wall units 7 of the first and the second round are connected together, the stop means 61 of the the connect mechanism 6 are pulled up, separating the latch rods 61 from the plates 60, and pour concrete again into the upper surfaces of the frame mechanism 2, connecting the side portion of the wall units 7 of the first round and the two thirds of the wall body 7 of the second round. In pouring concrete, the connect mechanisms 6 of the front and the rear walls units 7 have the plates 60 pushed open by concrete poured therein, as shown in FIG. 9, then the concrete of the wall units of the two rounds have the same structure, and the swingable plates 60 of the connect mechanisms 6 are swung to be combined together between the two wall units 7 reinforcing strength of the continuous walls, and permitting the two wall units 7 tightly contact with each other, with their water-proof function upgraded.

Figure 10:
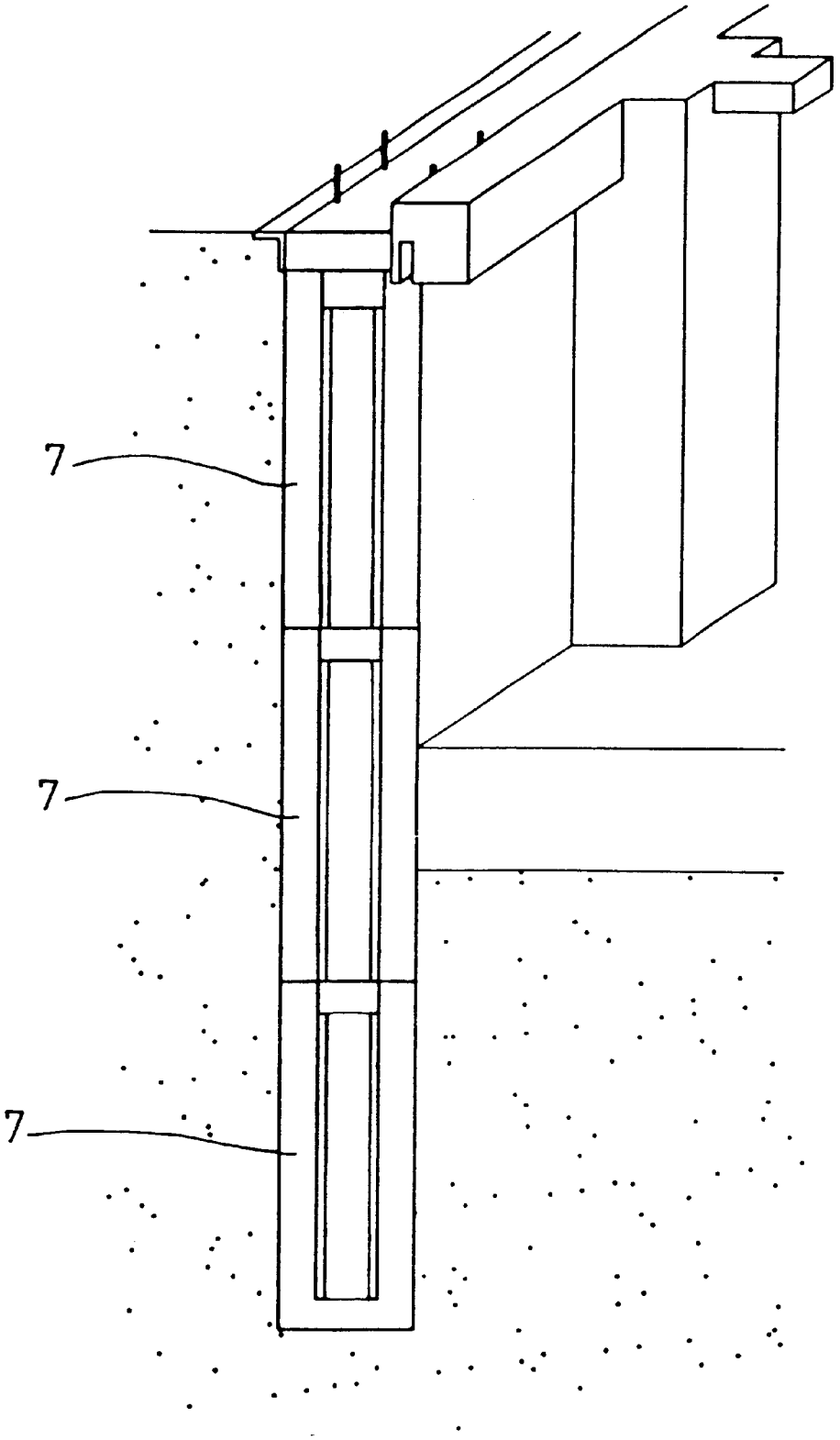
FIG. 10 is a perspective view of the underground continuous double-row walls of a basement connected with a floor of the basement in the present invention.

Construction is repeated according to the steps described above, until the whole continuous walls are completed, and then dig work can be proceeded for the foundation until it is wholly dug out. After that, bolts and nuts N are used to pass through the threaded holes 200 of the side frames 20 to secure tightly the wall bodies 7 already connected together. The sides of the front and the rear wall units 7 are secured together, and the connect steel bars 3 are pulled out to extend in the walls of the basement and connected with steel bars of the foundation, as shown in FIG. 10.

The double-row wall of the lowermost wall unit 7 may have a flat bottom surface or a pointed one, but needs no insert plates 26 or any grooves 4 in the inner surface 1 of each row of the wall.

In concrete pouring work in the invention, the lowest layer of the wall unit 7 placed in the ditch B can be poured in concrete first, and repeat the same work for the second lowest layer of the wall unit 7, and so on to complete the continuous walls.

The invention has the following advantages, as can be understood by the aforesaid description.

1. It can improve insufficient strength of the protective layer, insufficient bend stress of steel bars (reinforcement), rupture of walls, corrosion of steel bars in the conventional method of constructing underground continuous walls, by the compound constructing processes using prefabricated double-row wall units with industrial mass production. In addition, a front and a rear wall unit are connected with each other by pouring concrete between the double-row walls to let the front and the rear wall unit formed as integral, with water leak at the connect points improved as well.

2. The double-row walls of a single wall unit have resistance against pressure of the ground, improving drawbacks of soil slip and soil mixing in concrete after a long period of use of the steel bar cage with concrete in the conventional method, and improving drawback of bad quality of improper sand mixing in sand.

3. It can improve connection of every two neighboring wall units, by means of the connect mechanism 6 having two pairs of two plates pivotally connected with hinges to let one plate swing open by concrete poured in the space between the double-row walls, and the two swingable plates can be connected with each other to help secure the two neighboring wall units stably together.

4. An upper wall unit and a lower wall unit are tightly secured together with bolts and nuts, with the depth of construction unlimited, improving a disadvantage of hanging transportation of steel bar cages and placing PC plates in the conventional method, without limit in its length, height in transportation or in the space for construction.

5. The single wall units are prefabricated, having the same size and shape to be placed in the ditches, possible to effectively keep the accuracy of the wall surfaces.

6. Every surface of the single double-layer wall unit is in advance coated with water-proof paint, and a water-proof bands are laid between every two upper and lower wall units, having a perfect water-proof function.

7. Connecting steel bars are preset in the wall unit, for benefit of connecting with steel bars of the foundation, further upgrading strength between the continuous walls and the foundation.

8. Recesses for the connecting steel bars are preset, and a water-proof band is also can be laid in the recesses to prevent water leak, and in addition, to the effect of securing the wall of the foundation with the continuous walls.

9. Quality of the single wall units can be ensured by sufficient reliable management, needing no overdesign, and safer than those made by the conventional method.

While the preferred embodiment of the invention has been described above, it will be recognized and understood that various modifications may be made therein and the appended claims are intended to cover all such modifications which may fall within the spirit and scope of the invention.

What is claimed is:

1. A constructing method for underground continuous double-row walls comprising the steps of:

1. a first step of constructing guide walls;
2. a second step of digging a ditch;
3. a third step of checking verticality;
4. a fourth step of washing stop plates and removing dirt and mud on the bottom of said ditch;
5. a fifth step of constructing a first wall unit of continuous double-row walls; said wall unit having a double-row wall including an upper base plate and a lower base plate located symmetrically, a framework combined between said two base plates and having plural auxiliary frames combined between said upper and said lower base plate, and plural lateral bars passing through said auxiliary frames, plural net members fixed between said auxiliary frames, plural truss-type bars fixed between two of said auxiliary frames, mold plates fixed on an outer side of said wall unit, and concrete poured into said wall unit, which then becomes said single wall unit;
6. a sixth step of combining an upper wall unit with a lower wall unit; said upper wall unit and said lower wall unit placed in said ditch, and concrete poured into said upper wall unit; and,
7. a seventh step of repeating said second step to said sixth step until all said wall units are finished; wherein said continuous walls having each said wall unit stably connected to one another and effective waterproof, and preventing accidents of soil slip and soil mixing in concrete, improving insufficient strength of the reinforcing layer, insufficient bend stress, rupture of the walls, corrosion of steel bars and improper sand mixing in sand, said upper and said lower wall being tightly screwed together stably, thus permitting unlimited depth of construction and easy to control management of construction.

2. A structure of a single wall unit of continuous double-row walls comprising:

an upper and a lower base plate located symmetrically;

a framework combined between said upper and said lower base plate, having plural auxiliary frames combined between said upper and said lower base plate, plural lateral steel bars laterally fixed on said auxiliary frames, plural net members provided between every two of said auxiliary frames, plural steel bars connected between every two of said auxiliary frames; and, outer mold plates fixed on an outer surface of said framework, then concrete poured into the space between said outer mold plates and said net members, said single wall unit becoming one unit of said continous walls after concrete hardens; said structure of said prefabricated single wall unit of said continuous wall being beneficial for industrial mass production and convenient for transportation, not limited in the depth of construction, having sufficient strength, fine accuracy and tightness after combined into said continuous wall.

3. The structure of a single wall unit of continuous double-row walls as claimed in claim 2, wherein said base plate is shaped as T, a horizontal plate portion being a connect plate, a vertical plate portion being a reinforcing plate, and plural holes of different size provided in said connect plate.

4. The structure of a single wall unit of continuous double-row walls as claimed in claim 2, wherein said framework has a side frame respectively at two sides of said upper and said lower base plate, said side frame is connected to a side surface of another wall wall unit of said continuous double-row wall.

5. The structure of a single wall unit of continuous double-row walls as claimed in claim 1, wherein every two of said auxiliary frames of said framework have plural support rods between said two auxiliary frames, said support rods made of straight steel bar or angle steel, each said support rod having one end formed as a connect end with a recess and the other end having an extension protruding said upper base plate so that said one end of each support rod fits with said extension of another support rod to connect said upper wall unit with said lower wall unit.

6. The structure of a single wall unit of continuous double-row walls as claimed in claim 5, wherein said support rods respectively have said connect end having a hole for steel bar support rod connected with said connect end by means of a connector.

7. The structure of a single wall unit of continuous double-row walls as claimed in claim 5, wherein each said auxiliary frame having a connect plate fixed laterally at an upper end and an insert plate fixed laterally at a lower end, said connect plate of said lower wall unit resting against said insert plate of said upper wall unit to permit said upper and said lower wall unit secured with each other fast and stably.

8. A constructing method of continuous double-row walls and a structure of its single wall unit comprising a constructing method comprising the steps of:

1. a first step of constructing guide walls;
2. a second step of digging a ditch;
3. a third step of checking verticality;
4. a fourth step of washing stop plates, and removing dirt and mud on the bottom of said ditch;
5. a fifth step of constructing a first single wall unit of continuous double-row walls; said single unit having two rows of walls and including an upper and a lower base plate, a framework including a plurality of auxiliary frames between said upper and said lower base plate, plural lateral bars laterally fixed with said auxiliary frames, plural net members fixed between every two of said auxiliary frame, a truss-style steel bar fixed between every two of said auxiliary frames; mold plates fixed on two outer sides of said prefabricated framework and then concrete poured into single wall unit;
6. a sixth step of connecting an upper wall unit and a lower wall unit; said wall units of continuous walls piled up and lowered in said ditch, and concrete poured into said upper wall unit;
7. a seventh step of repeating said second step to said sixth step until all continuous walls are finished; and, a connect mechanism provided between every two neighboring wall units of continuous double-row walls.

9. The constructing method for underground continuous double-row walls as claimed in claim 8, wherein said connect mechanism has two pairs of two plates at two opposite ends, one said pair of two plates being connected pivotally with hinges to be swingable, a stop means stopping an inner surface of said swingable plate, said swingable plate functioning as a side stop plate, said swingable plate forced to swing open to a side of another said wall unit when concrete is poured into said wall unit, said swingable plate connected to said side of another wall unit to secure and strengthen connection of two neighboring wall units.

10. The constructing method for underground continuous double-row walls as claimed in claim 9, wherein said pairs of two plates of said connect mechanism function as two panel door, one panel hinged with the other to swing freely to become straight or bent.

11. The constructing method for underground continuous double-row walls as claimed in claim 9, wherein said pair of two plates has plural hooks fixed vertically spaced apart on an inner surface.

12. The constructing method for underground continuous double-row walls as claimed in claim 9, wherein said stop means of said connect mechanism has a vertical rod and plural lateral latch rods extending from said vertical rod sidewise to be hooked by said hooks of said pair of two plates, and clamp type hook latches for connecting an upper vertical rod and a lower vertical rod of said stop means.

13. The constructing method for underground continuous double-row walls as claimed in claim 1 or 8, wherein reinforcing steel bars are provided slopingly between said net members or said auxiliary frames or said support rods, depending on needs of the construction.

14. The constructing method for underground continuous double-row walls as claimed in claim 1 or 8, wherein when a layer of said continuous walls are connected together, concrete is poured in said layer of said continuous walls, then repeat the same work after another layer of said continuous walls is connected, thus said concrete between said double rows of said walls forming a part of the whole walls.

15. The constructing method for underground continuous double-row walls as claimed in claim 1 or 8, wherein water-proof bands are laid between said upper wall unit and said lower wall unit, and then said upper and said lower wall unit are secured together with bolts and nuts.

16. The constructing method for underground continuous double-row walls as claimed in claim 1 or 8, wherein said water-proof bands are laid between a front wall unit and a rear wall unit, and inner sides of two wall units of said continuous walls are screwed together with bolts and nuts after finishing digging a foundation.

* * * * *